US007872606B1

(12) United States Patent
Cheng

(10) Patent No.: US 7,872,606 B1
(45) Date of Patent: Jan. 18, 2011

(54) COMPACT ULTRA WIDEBAND MICROSTRIP RESONATING ANTENNA

(75) Inventor: Dajun Cheng, Acton, MA (US)

(73) Assignee: Marvell International Ltd., Hamilton (BM)

( * ) Notice: Subject to any disclaimer, the term of this patent is extended or adjusted under 35 U.S.C. 154(b) by 381 days.

(21) Appl. No.: 12/029,327

(22) Filed: Feb. 11, 2008

Related U.S. Application Data

(60) Provisional application No. 60/889,108, filed on Feb. 9, 2007.

(51) Int. Cl.
*H01Q 1/38* (2006.01)

(52) U.S. Cl. ..... 343/700 MS; 343/846

(58) Field of Classification Search ..... 343/700 MS, 343/846, 848
See application file for complete search history.

(56) References Cited

U.S. PATENT DOCUMENTS

| | | | | |
|---|---|---|---|---|
| 4,835,538 | A * | 5/1989 | McKenna et al. | 343/700 MS |
| 5,382,959 | A * | 1/1995 | Pett et al. | 343/700 MS |
| 5,497,164 | A * | 3/1996 | Croq | 343/700 MS |
| 6,133,882 | A * | 10/2000 | LaFleur et al. | 343/700 MS |
| 2002/0089452 | A1 * | 7/2002 | Lovestead | 343/700 MS |
| 2002/0113737 | A1 * | 8/2002 | Brachat et al. | 343/700 MS |
| 2008/0106470 | A1 * | 5/2008 | Hu et al. | 343/700 MS |

* cited by examiner

*Primary Examiner*—HoangAnh T Le

(57) ABSTRACT

An Ultra Wide Band (UWB) antenna includes a base substrate that includes a signal feed and two or more antenna substrates communicatively coupled with the signal feed. Each antenna substrate includes a plurality of microstrip resonating lines.

34 Claims, 10 Drawing Sheets

COMPACT ULTRA WIDEBAND MICROSTRIP RESONATING ANTENNA

CROSS REFERENCE TO RELATED APPLICATIONS

The present application claims priority to U.S. Patent Application No. 60/889,108, filed Feb. 9, 2007, entitled "Compact Ultra Wideband Microstrip Resonating Antenna," the entire specification of which is hereby incorporated by reference in its entirety for all purposes, except for those sections, if any, that are inconsistent with this specification.

TECHNICAL FIELD

Embodiments of the present invention relate to the field of wireless communication, and more particularly, to a compact, ultra wideband microstrip resonating antenna for use in wireless transmission.

BACKGROUND

Ultra wideband (UWB) is a radio technology that may be used for short range high band width communications by using a large portion of the radio spectrum in a way that doesn't interfere with other more traditional "narrow band" uses. According to the Federal Communications Commission (FCC), UWB may be used to refer to any radio technology having band width exceeding the lesser of 500 MHz or 20% of the arithmetic center frequency. Thus, generally, UWB is defined as 3.1-10.6 GHz. This is intended to provide an efficient use of scarce real band width while enabling both high data rate Personal Area Network (PAN) wireless connectivity and longer range, low data rate applications, as well as radar and imaging systems.

Examples of devices that operate utilizing UWB technology include, but are not limited to, mobile wireless devices (e.g., handset, hand-held and notebook-type devices), consumer electronic devices (e.g., digital camera, camcorder, MP3), and other UWB application areas (e.g., broadband wireless connectivity for a digital home application). As may be seen, these types of devices often operate within a PAN. Among the challenges with UWB applications is an effective UWB antenna. Often, UWB antennas tend to be large and are limited in capacity and balance such that they may require a Balun component. Additionally, achieving balanced feeding techniques in current UWB feeding designs is difficult and thus, the overall cost of a UWB system is often greater than desired.

SUMMARY

In accordance with various embodiments of the present invention, an Ultra Wide Band (UWB) antenna includes a base substrate that includes a signal feed and two or more antenna substrates communicatively coupled with the signal feed. Each antenna substrate includes a plurality of microstrip resonating lines.

In accordance with various embodiments, at least two of the microstrip resonating lines within at least one antenna substrate are of different lengths.

In accordance with various embodiments, the UWB antenna includes at least three antenna substrates.

In accordance with various embodiments, the signal feed comprises of at least one feeding line.

In accordance with further embodiments of the present invention, the feeding lines each include an impedance matching circuit.

In accordance with various embodiments, the signal feed comprises two differential feeding lines, each including an impedance matching circuit.

In accordance with various embodiments, the microstrip resonating lines are communicatively coupled to the feeding lines via at least one aperture defined within a ground plane coupled to the base substrate.

In accordance with other embodiments, the feeding lines may be directly coupled to one of the antenna substrates.

In accordance with further embodiments of the present invention, the ground plane is directly coupled to one of the antenna substrates and each differential feeding line includes a differential feeding pad to communicatively couple the differential feeding lines with the microstrip resonating lines.

In accordance with various embodiments, the signal feed comprises at least one coaxial probe connector extending from a ground plane to a coupling pad.

In accordance with further embodiments, the coupling pad includes impedance matching stubs.

In accordance with further embodiments, the coupling pad is comprised of two differential coupling pads and the signal feed is comprised of two coaxial probe connectors, each one being coupled to a respective one of the differential coupling pads.

The present invention also provides a method comprising arranging a base substrate that includes a signal feed, and arranging two or more antenna substrates communicatively coupled with the signal feed, each antenna substrate including a plurality of microstrip resonating lines.

In accordance with various embodiments, the method further comprises arranging a ground plane coupled to a bottom of the base substrate and a coupling pad coupled to a top of the base substrate and one of the antenna substrates, wherein the signal feed comprises at least one coaxial probe connector extending from the ground plane to the coupling pad.

Other features that are considered as characteristic for embodiments of the invention are set forth in the appended claims.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

For the purposes of the present invention, the phrase "A/B" means A or B, or A and B. For the purposes of the present invention, the phrase "A and/or B" means "(A), (B), or (A and B)". For the purposes of the present invention, the phrase "at least one of A, B, and C" means "(A), (B), (C), (A and B), (A and C), (B and C), or (A, B and C)". For the purposes of the present invention, the phrase "(A)B" means "(B) or (AB)" that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

Embodiments of the present invention provide a compact ultra wideband microstrip resonating antenna.

Figure 1:
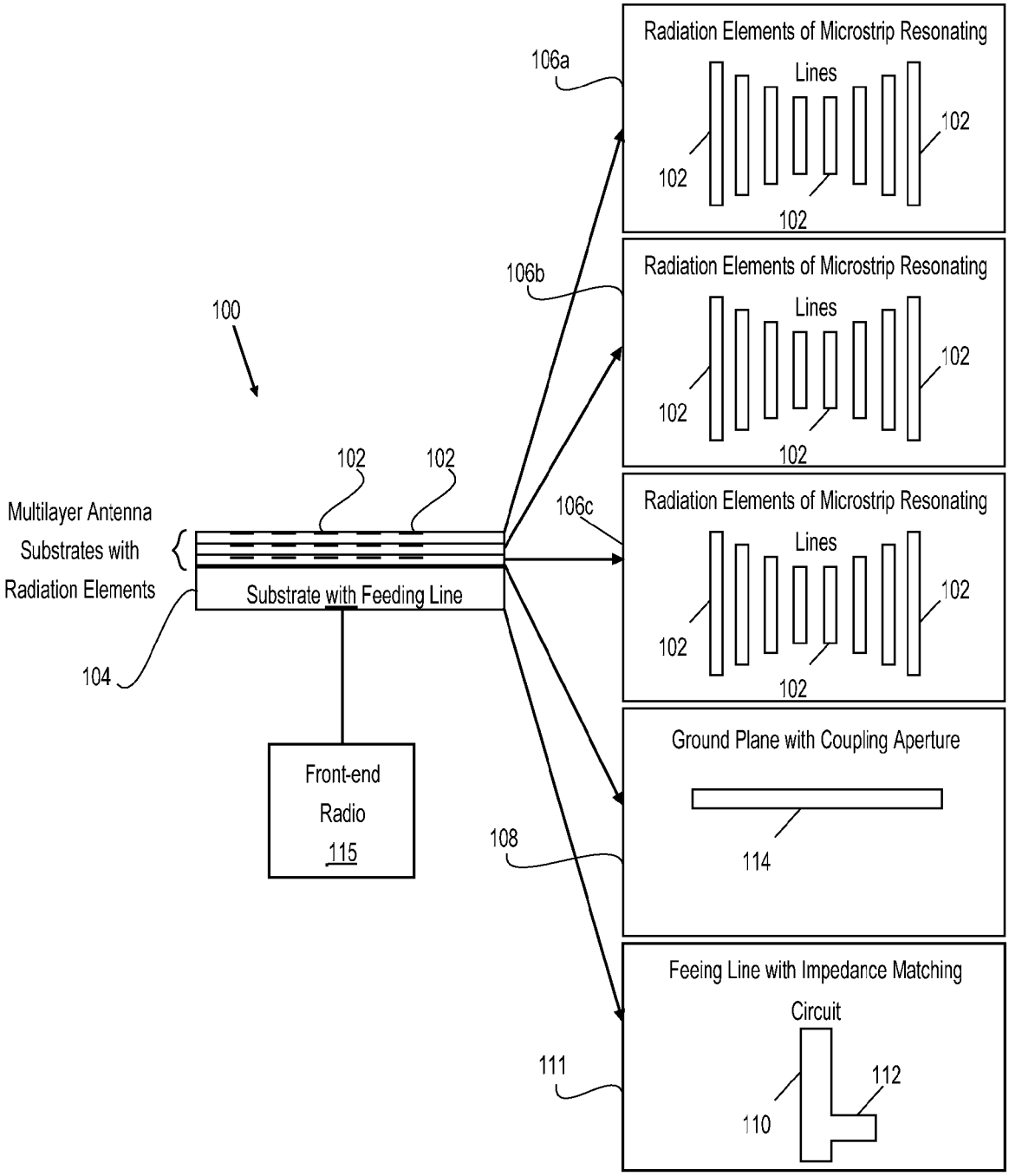
FIG. 1 schematically illustrates an ultra wideband (UWB) antenna, in accordance with various embodiments of the present invention.

In general, embodiments of the present invention provide a compact UWB microstrip resonating antenna 100 that includes a plurality of radiation elements 102, and more particularly, a plurality of resonating microstrip lines formed from the radiation elements 102 that are printed on substrates in a multi-layered configuration. FIG. 1 schematically illustrates an embodiment of a UWB microstrip resonating antenna 100 and as may be seen, the UWB antenna 100 includes multiple substrates. A base substrate 104 is provided and as well as, in this exemplary embodiment, three antenna substrates 106*a*, 106*b*, 106*c*. Those skilled in the art will understand that more or fewer antenna substrates may be provided depending on the application. A ground plane 108 is defined within the base substrate 104. The ground plane 108 is adjacent to the antenna substrate 106*c*. A signal feed 110 is provided within a plane 111 of the base substrate 104 for providing signals in the form of electromagnetic energy for the radiation elements 102. In accordance with various embodiments, the signal feed 110 is a feeding line formed within the base substrate 104 and includes an impedance matching circuit 112.

In the exemplary embodiment of FIG. 1, the feeding scheme for the UWB antenna 100 is in the form of aperture coupling, that is each of the radiation elements 102 is electromagnetically coupled to the feeding line 110 by a coupling aperture 114 etched in the ground plane 108. Thus, the radiation elements 102 receive signals for transmission in the form of electromagnetic energy from a front-end radio 115 via the feeding line 110 and the coupling aperture 114. As previously noted, the feeding line 110 includes an impedance matching circuit 112 for impedance matching of the radiation elements 102 such that the electromagnetic energy provided to the radiation elements 102 is maximally coupled to the UWB antenna 100.

Figure 2A:
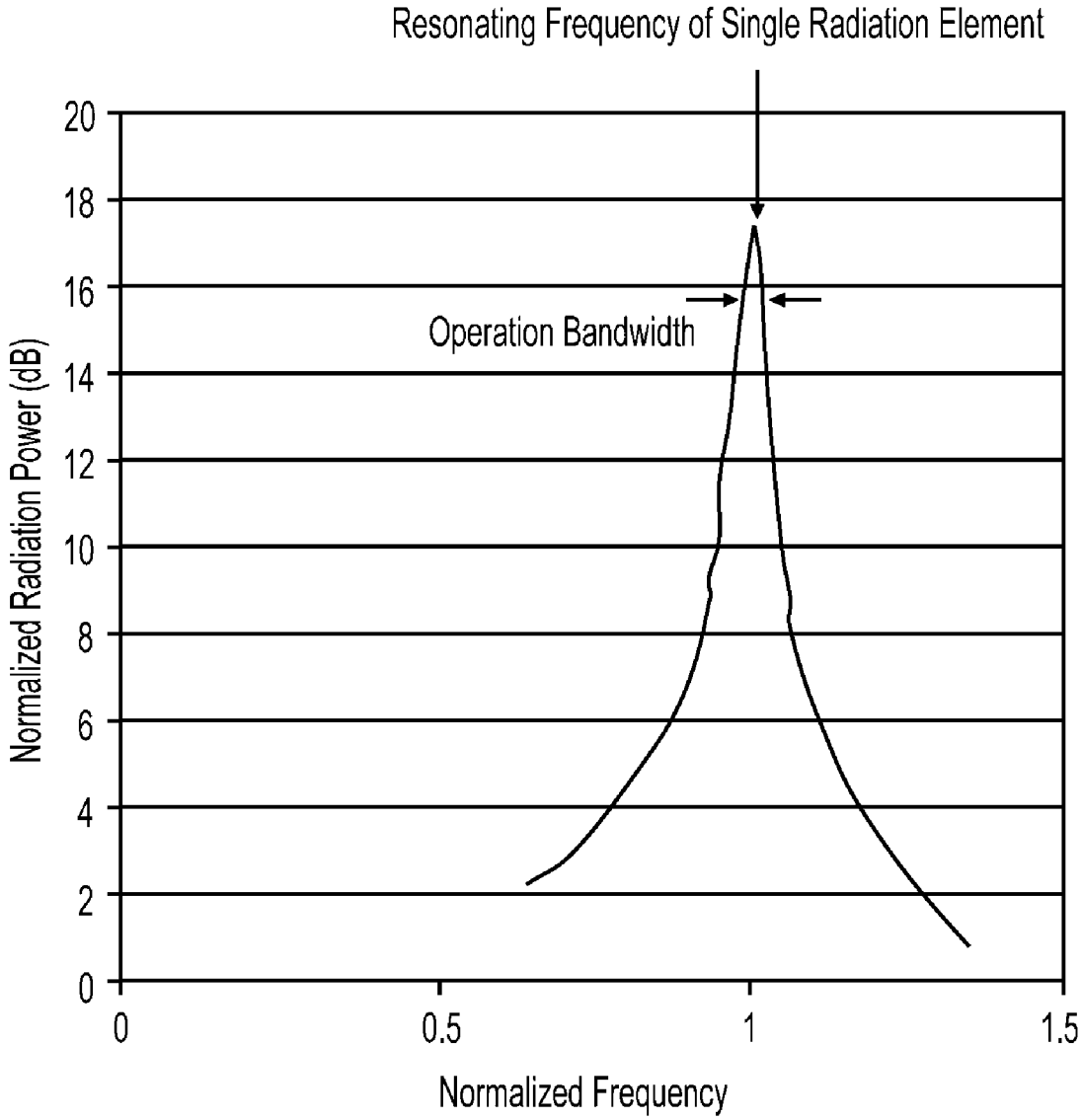
FIG. 2A-2B graphically illustrates frequency response of a single radiation element and multiple radiation elements of a UWB antenna, in accordance with various embodiments of the present invention.
Figure 2B:
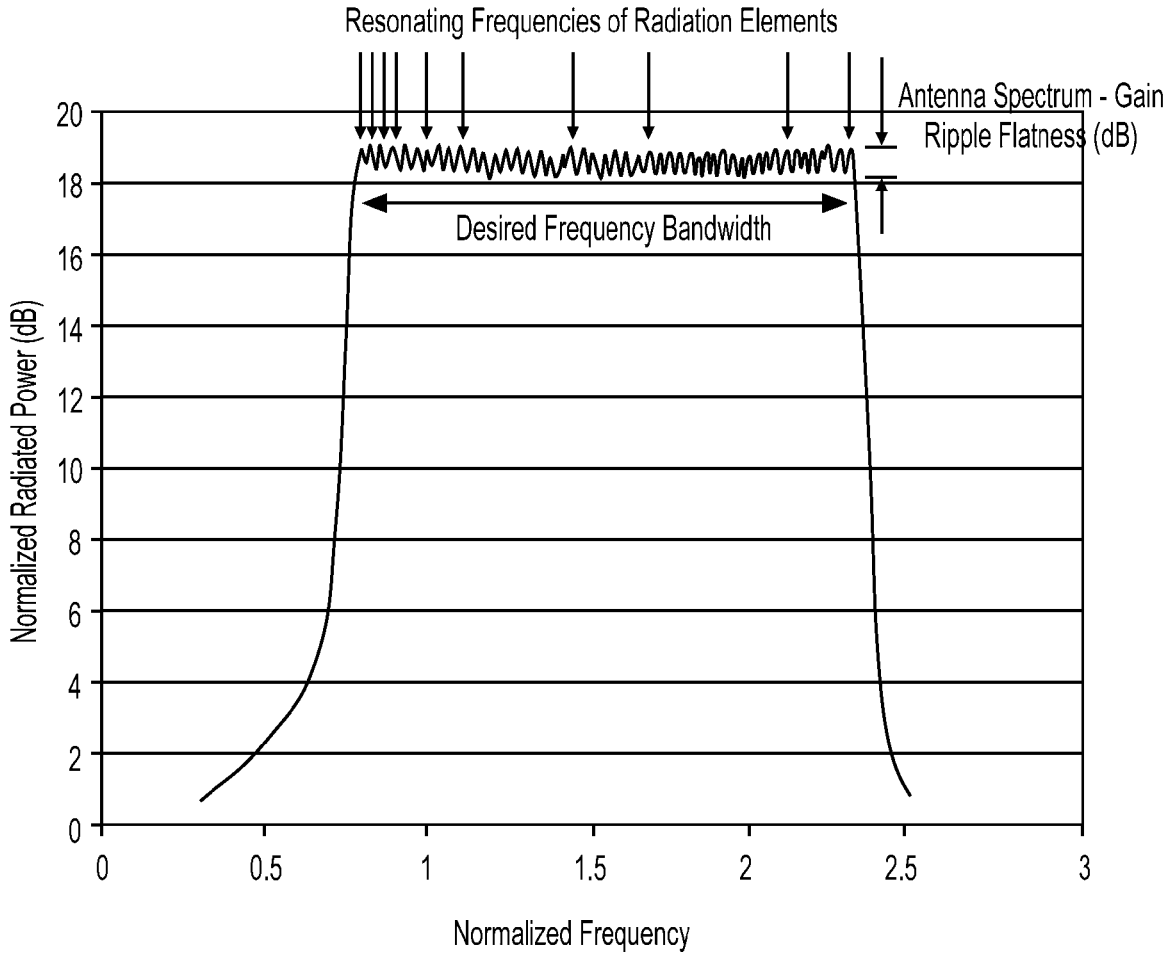
Figure 3:
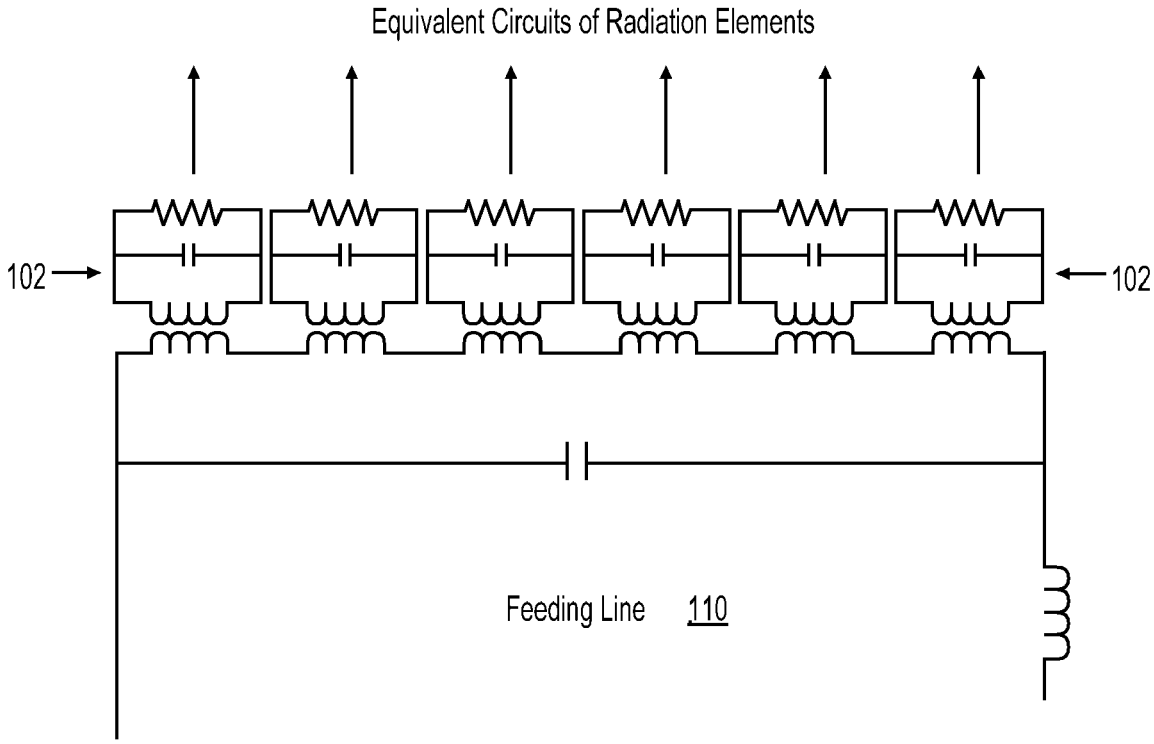
FIG. 3 schematically illustrates an equivalent circuit of a UWB antenna, in accordance with various embodiments of the present invention.
Figure 4A:
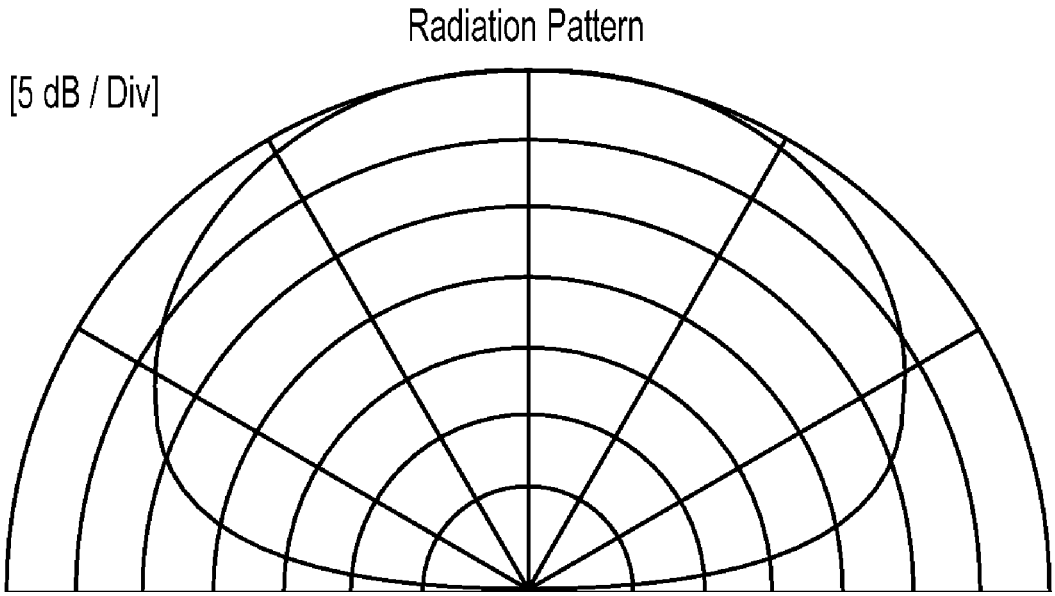
FIG. 4A-4B graphically illustrates a radiation pattern of a radiation element for a UWB antenna, in accordance with various embodiments of the present invention.
Figure 4B:
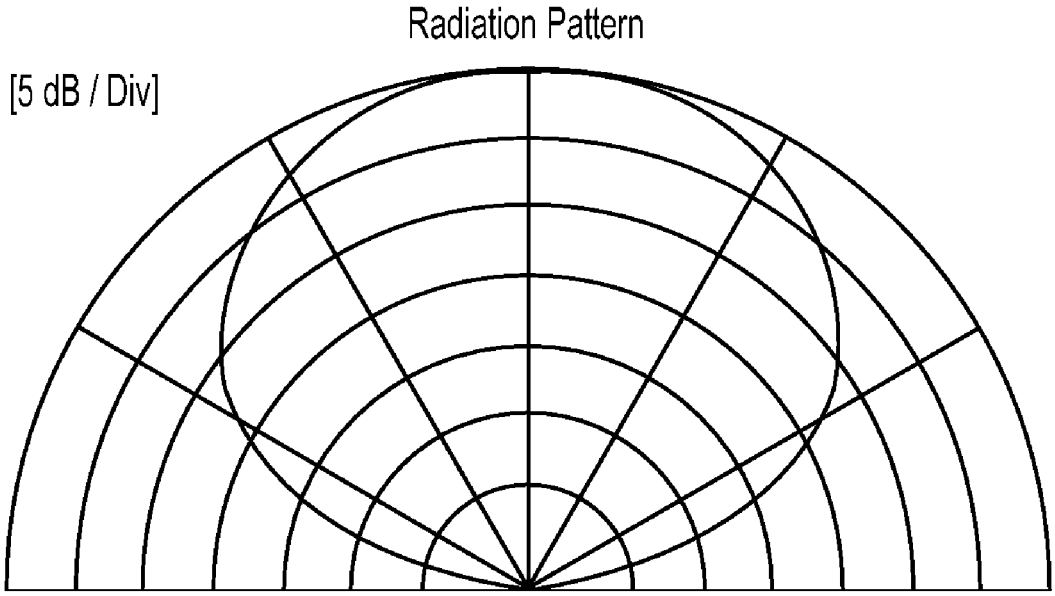

As may be seen in FIG. 1, in accordance with the various embodiments, many of the radiation elements 102 printed on the same substrate have slightly different lengths such that the radiation elements 102 have a slightly different resonating frequency. Thus, the resonating frequencies of the radiation elements 102 are provided within the UWB antenna 100 in order to cover the total desired operational bandwidth (e.g., 3.1 to 10.6 GHz) within predefined antenna spectrum-gain ripple flatness. FIG. 2 graphically illustrates the frequency-comparison of a single microstrip radiation element 102 and multiple radiation elements 102. Thus, as may be seen in FIG. 2*b*, the operational bandwidth of the UWB antenna 100 is extended by using multiple radiation elements. FIG. 3 illustrates an example of an equivalent circuit of the radiation structure of the radiation elements and aperture-coupled feeding schemes. In the example antenna illustrated in the embodiment of FIG. 1, there are a total of 24 radiation elements. Thus, 24 bands are provided for in the embodiment of FIG. 1. However, for clarity and simplicity, only six radiating elements are illustrated in the equivalent circuit example of FIG. 3. FIG. 4 illustrates the radiation pattern of a single radiation element 102 with FIG. 4*a* illustrating the pattern wherein Phi=0° and FIG. 4*b* illustrating a pattern wherein Phi=90°.

Figure 5:
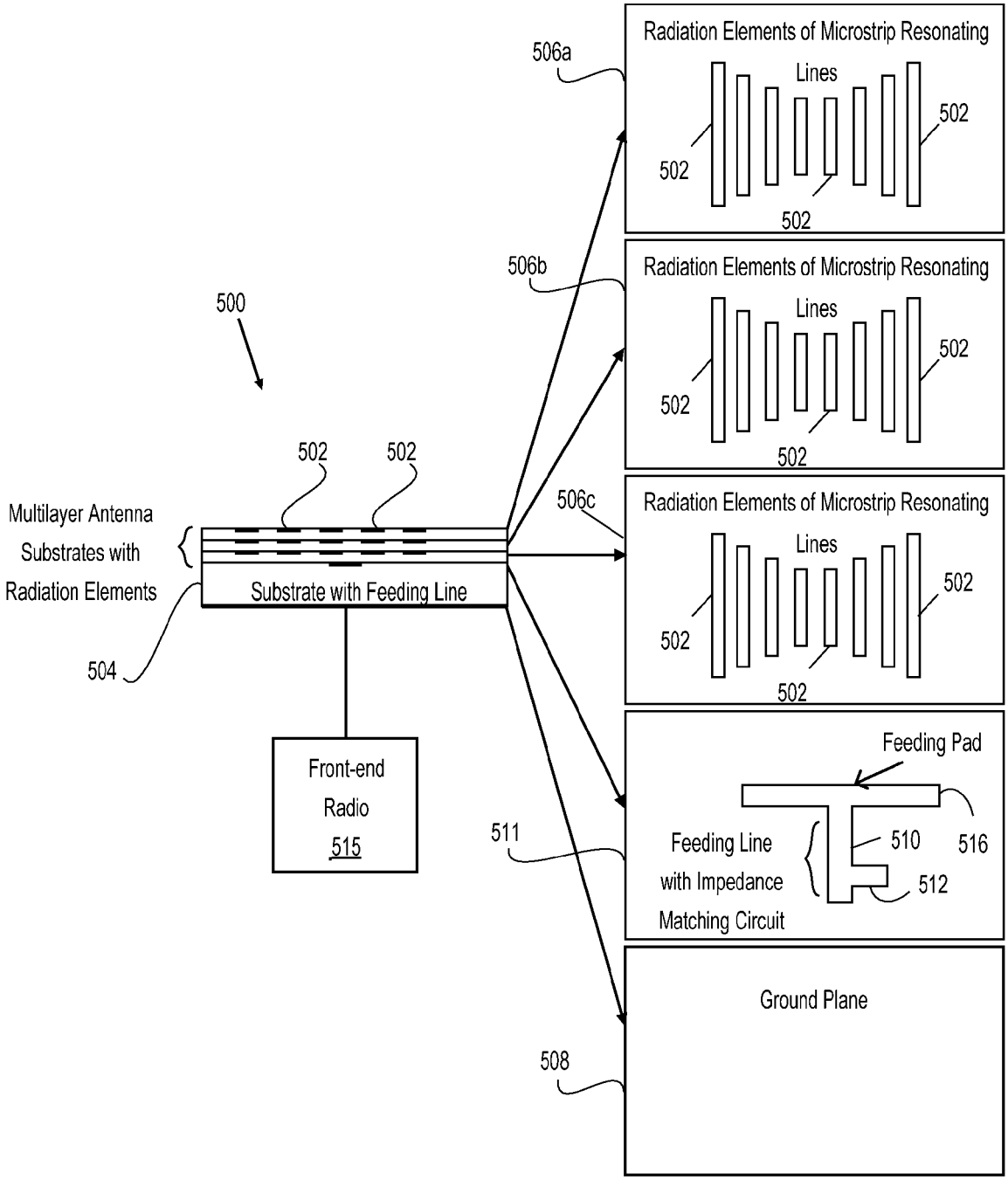
FIG. 5 schematically illustrates a UWB antenna, in accordance with various embodiments of the present invention.

While FIG. 1 illustrates an embodiment wherein the UWB microstrip resonating antenna 100 employs an aperture coupling to communicatively couple the radiation elements 102 to the feeding line 110, other feeding schemes may be employed. For example, FIG. 5 schematically illustrates a UWB microstrip resonating antenna 500 that utilizes a feeding scheme of a microstrip-transmission-line direct coupling, where the radio signal is electromagnetically coupled with the antenna substrates 506*a*, 506*b*, 506*c* via a feeding pad 516 provided within plane 511 of base substrate 504. In accordance with various embodiments, the feeding pad 516 is oriented perpendicular to the axis of the radiation elements 502 in order to provide for maximal energy coupling. As in the embodiment illustrated in FIG. 1, the feeding line 510 includes an impedance matching circuit 512 that is connected to the feeding pad 516 on the base substrate 504. The feeding line 510 receives signals 502 from front-end radio 515 for transmission by the radiation elements.

Figure 6:
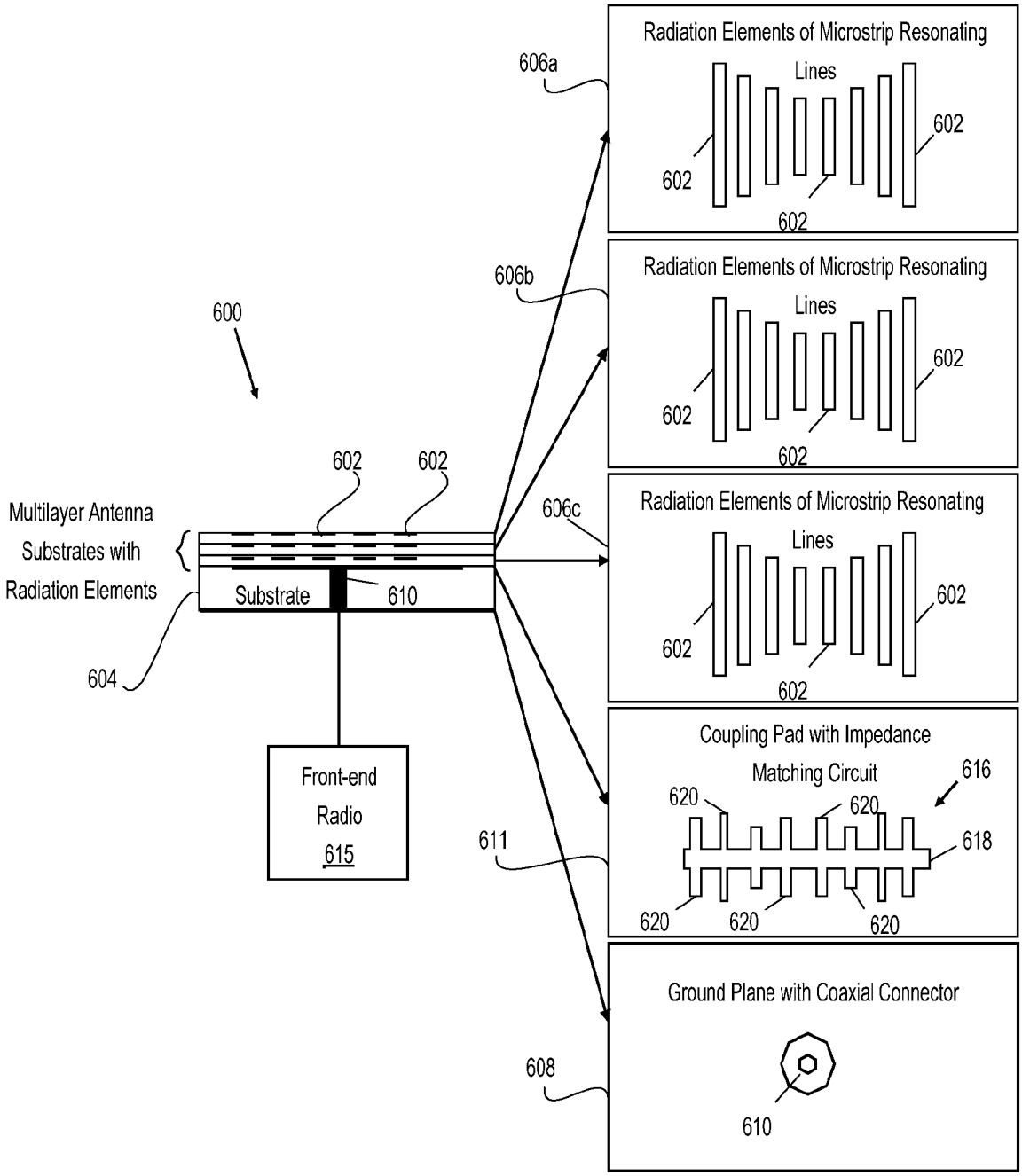
FIG. 6 schematically illustrates a UWB antenna, in accordance with various embodiments of the present invention.

FIG. 6 schematically illustrates another example of a UWB microstrip resonating antenna 600 in accordance with various embodiments for the present invention. In this embodiment, the feeding scheme utilizes a probe-feed coupling. Thus, the radio signal is electromagnetically coupled to the antenna substrates via coupling pad 616 provided within plane 611 of base substrate 604. The coupling pad 616 includes a printed strip line 618 perpendicular to the radiation elements 602. Additionally, the coupling pad 616 includes stubs 620 for impedance matching in order to maximize the electromagnetic energy coupling. A feeding probe in the form of a coaxial probe connector 610 provides signals for transmission by the antenna substrates 606*a*, 606*b*, 606*c* and extends through a hole defined within the ground plane 608 of the base substrate 604 extending through the base substrate 604 to the coupling pad 616. The coaxial probe connector 610 receives the signals from front-end radio 615 for transmission by the radiation elements 602.

Figure 7:
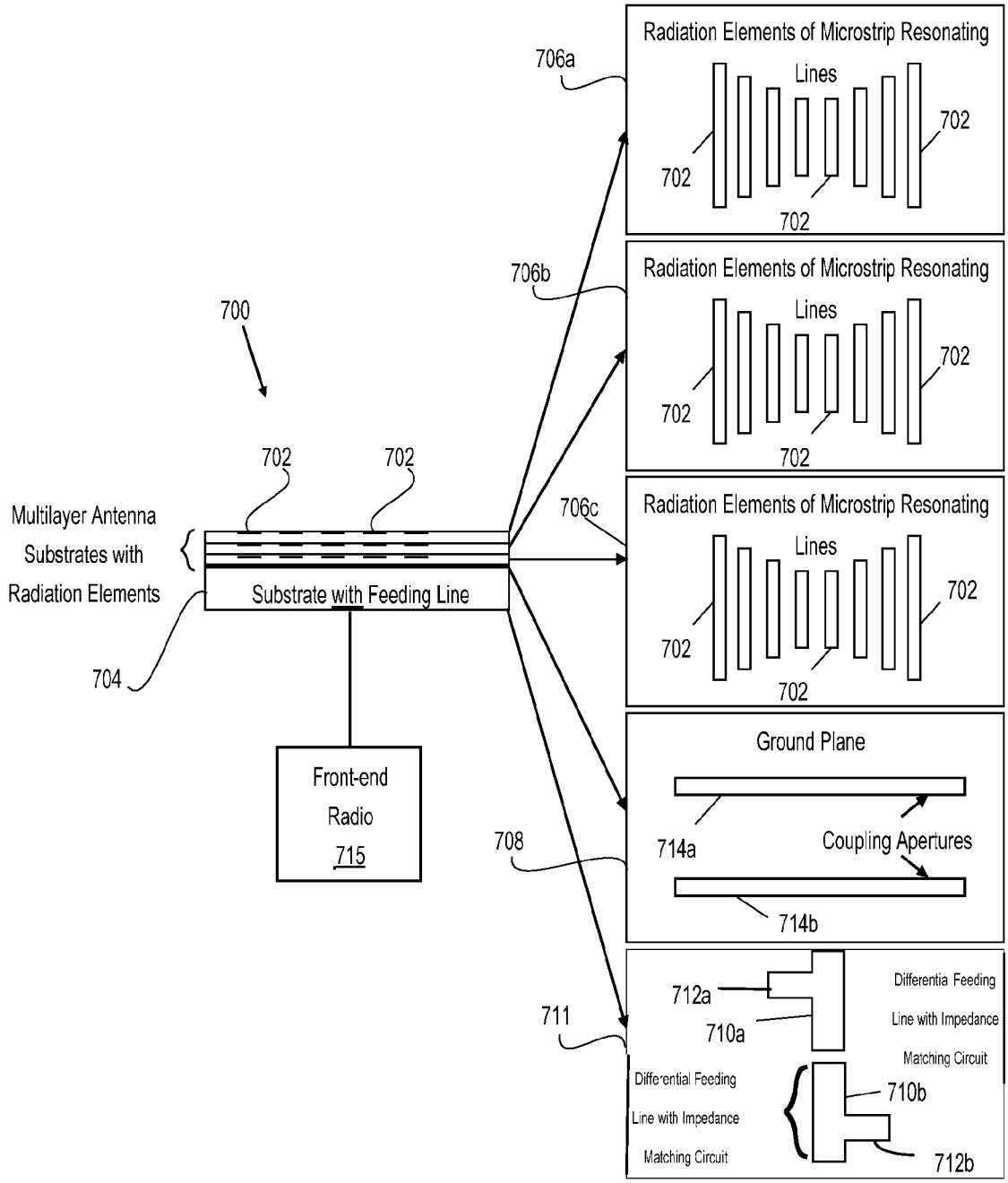
FIG. 7 schematically illustrates a UWB antenna, in accordance with various embodiments of the present invention.

In accordance with various embodiments of the present invention, balanced feeding techniques may be provided in further embodiments of the present invention. For example, FIG. 7 illustrates an embodiment of a UWB microstrip resonating antenna 700, and in accordance with various embodiments, it includes balanced aperture-coupling feeding. Two coupling apertures 714*a*, 714*b* are defined within the ground plane 708 and two feeding lines 710*a*, 710*b* are provided within plane 711 of the base substrate 704. The two feeding lines 710*a*, 710*b* include separate impedance matching circuits 712*a*, 712*b*. The pairs of coupling apertures 714*a*, 714*b* and feeding lines 710*a*, 710*b* are symmetrically positioned with respect to the radiation elements. The feeding lines 710*a*, 710*b* receive signals from front-end radio 715 for transmission by the radiation elements 702. Those skilled in the art will understand that the radio signals and the differential feeding lines are out of phase (180° difference) and hence, could connect to the differential signals of the front-end radio 715 directly.

Figure 8:
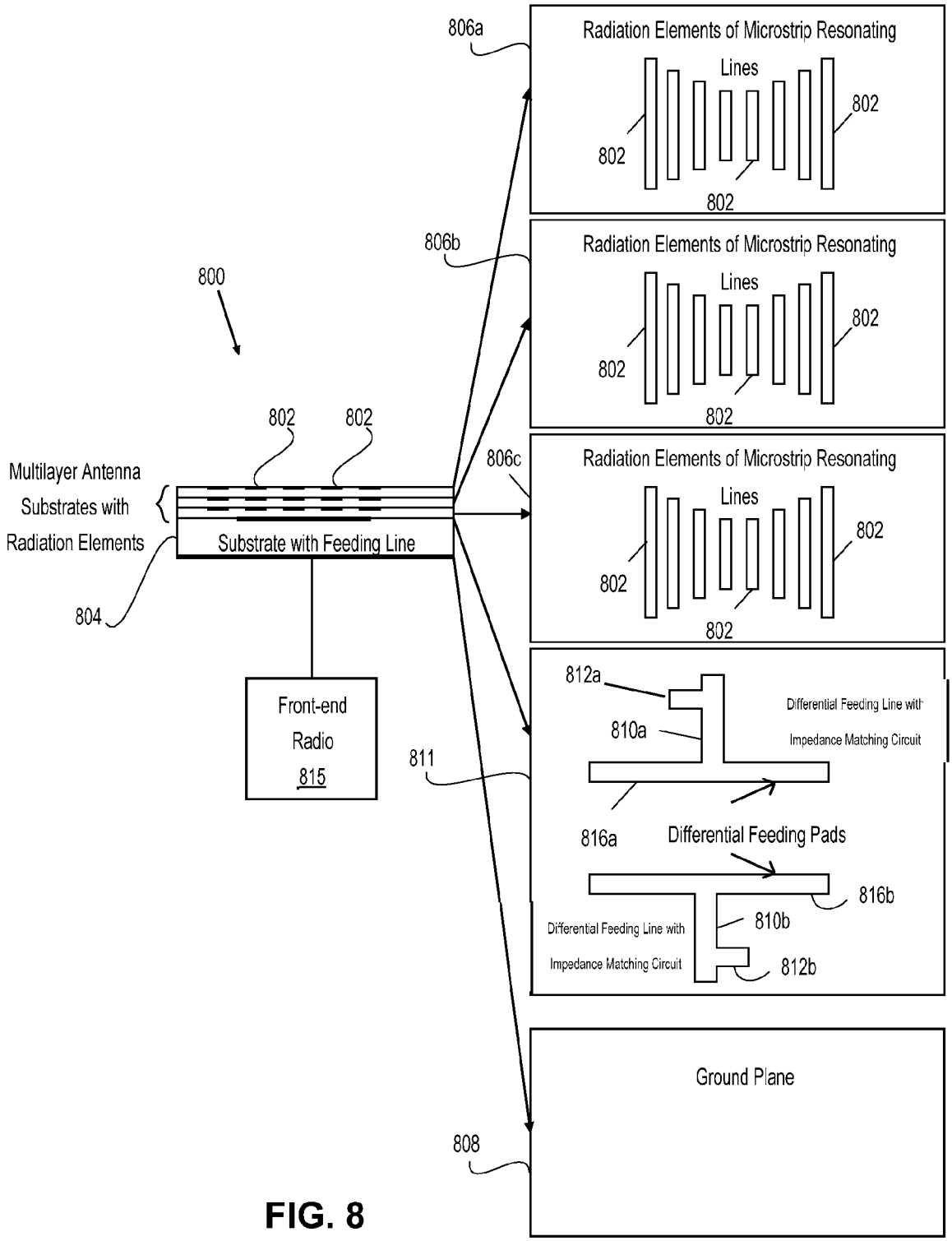
FIG. 8 schematically illustrates a UWB antenna, in accordance with various embodiments of the present invention.

FIG. 8 schematically illustrates a UWB microstrip resonating antenna 800 of another embodiment of a balanced microstrip-transmission-line antenna that includes a feeding scheme involving direct coupling. In this embodiment, differential feeding pads 816*a*, 816*b* are symmetrically positioned with reference to the radiation elements 802. The differential feeding lines 810*a*, 810*b* include separate impedance matching circuits 812*a*, 812*b* and connect with the differential feeding pads 816*a*, 816*b* on the same substrate plane 811 of base substrate 804. The feeding lines 810*a*, 810*b* receive signals from front-end radio 815 for transmission by the radiation elements 802. As with the embodiment illustrated in FIG. 7, the differential feeding lines 810*a*, 810*b* may be connected to the differential signals of the front-end radio 815 directly.

Figure 9:
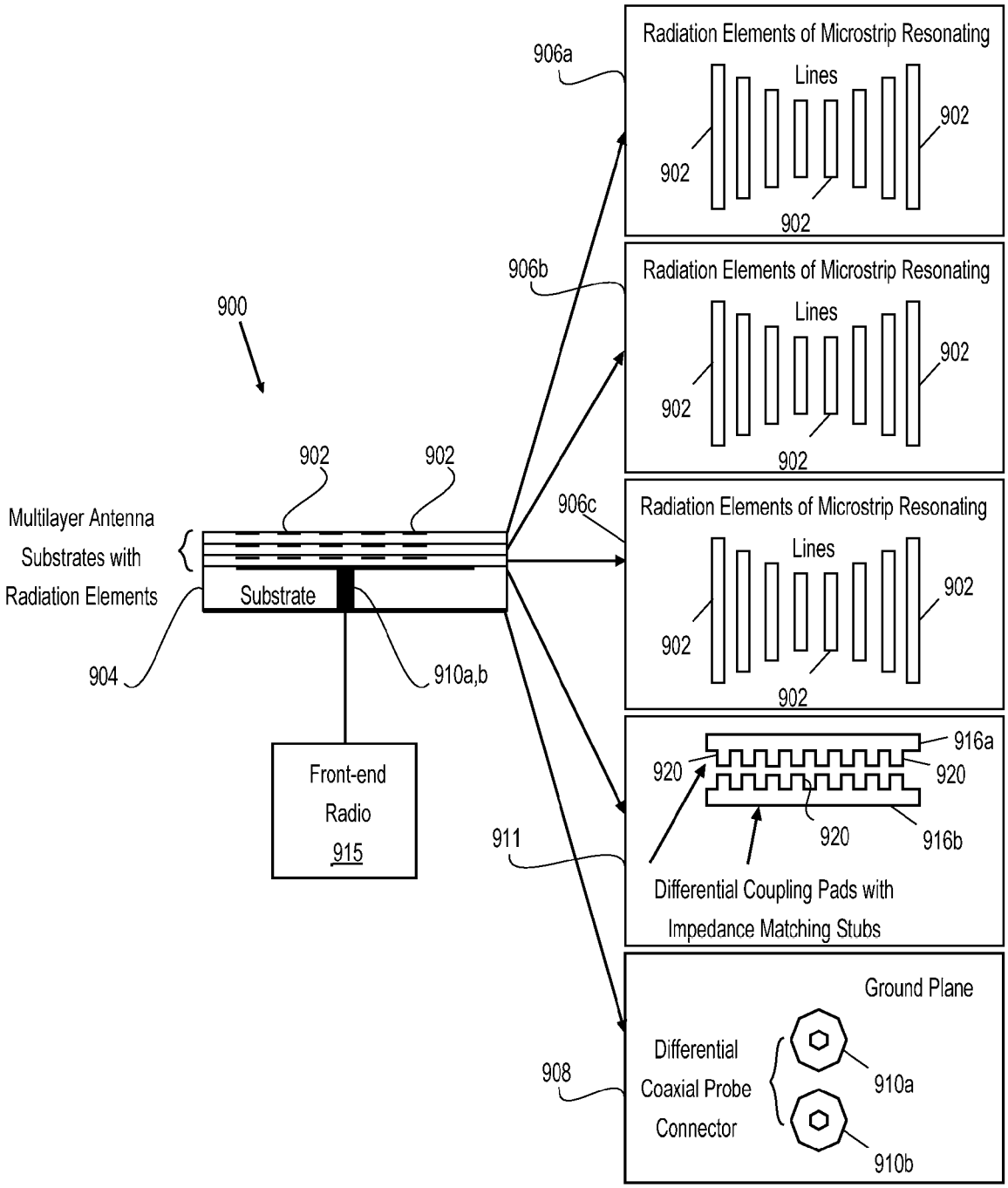
FIG. 9 schematically illustrates a UWB antenna, in accordance with various embodiments of the present invention.

FIG. 9 illustrates an embodiment of a UWB microstrip resonating antenna 900 that includes balanced probe feeding. In this embodiment, the differential signal is coupled to the antenna substrates 906*a*, 906*b*, 906*c* via two differential coupling pads 916*a*, 916*b* provided within plane 911 of base substrate 904. The two differential coupling pads 916*a*, 916*b* are symmetrically positioned with reference to the radiation elements 902. The differential coupling pads 916*a*, 916*b* include stubs 920 for impedance matching in order to allow for maximal electromagnetic energy coupling with the UWB antenna 900. The differential feeding probes in the form of coaxial probe connectors 910*a*, 910*b* may be coupled to the coupling pads 916*a*, 916*b* via dual holes defined within the ground plane 908 and may be coupled to the differential signals of the front-end radio 915 directly. Thus, the coaxial probe connectors 910*a*, 910*b* receive signals from front-end radio 915 for transmission by the radiation elements 902.

Since the resonating frequency of each radiation element is basically determined by its length and properties of the substrates (e.g., permittivity, permeability, height, etc.), the radiation elements printed on the same antenna substrate have slightly different lengths so that each of the radiation elements has slightly different resonating frequency. While the figures illustrate the embodiments as having the radiation elements arranged in a "bow-tie" arrangement, those skilled in the art will understand that they may be arranged in different configurations as desired. However, it is generally preferable to keep the radiation elements symmetrical to provide balanced feeding of signals to the radiation elements and thereby allow for better transmission. Additionally, while the exemplary embodiments illustrate 24 radiation elements, generally there will be on the order of a few hundred radiation elements and thus, by using multiple radiation elements, the bandwidth of a single radiation element is not critically important. As previously mentioned, there may be more or fewer antenna substrates depending on the application. Also, since the width of the radiation element may be very thin and the dielectric constant of the antenna substrates may be high (on the order of 40), the overall real estate size of the antenna system may be reduced (e.g., on the order of 9×9 mm). With the well known thin film manufacturing technology (such as, for example, low temperature, co-fired ceramic (LTTCC)), the overall height of the antenna system may not be significantly increased in the multilayered structure illustrated in the Figs., e.g., on the order of 2 mm. By using the balanced feeding techniques (e.g., balanced aperture-coupling feeding as illustrated in FIG. 7, balanced microstrip-transmission-line direct coupling as illustrated in FIG. 8, and balanced probe feeding as illustrated in FIG. 9), a UWB microstrip resonating antenna in accordance with various embodiments of the present invention may directly connect to the differential signals in the radio front end and thereby eliminate the need of a Balun component.

While the various embodiments of the present invention have been illustrated schematically, those skilled in the art will understand that the various components described and illustrated may be created by various techniques such etching and printing of the substrates. As previously noted, one example of an advantageous technique includes low temperature, co-fired ceramic (LTTCC).

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments illustrated and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. An ultra wideband (UWB) antenna comprising:

a base substrate that includes a signal feed, wherein the signal feed comprises at least one feeding line that includes an impedance matching circuit; and two or more antenna substrates communicatively coupled with the signal feed, each antenna substrate including a plurality of microstrip resonating lines, wherein the impedance matching circuit provides impedance matching across the plurality of microstrip resonating lines.

2. The UWB antenna of claim 1, wherein at least two of the microstrip resonating lines within at least one antenna substrate are of different lengths.

3. The UWB antenna of claim 1, wherein the UWB antenna comprises at least three antenna substrates.

4. The UWB antenna of claim 1, wherein the signal feed comprises two differential feeding lines each including an impedance matching circuit.

5. The UWB antenna of claim 4, wherein the microstrip resonating lines are communicatively coupled to the two differential feeding lines via two apertures defined within a ground plane coupled to the base substrate.

6. The UWB antenna of claim 4, wherein:

the ground plane is directly coupled to one of the antenna substrates; and each differential feeding line includes a differential feeding pad to communicatively couple the two differential feeding lines with the microstrip resonating lines.

7. The UWB antenna of claim 1, wherein the microstrip resonating lines are communicatively coupled to the at least one feeding line via at least one aperture defined within a ground plane coupled to the base substrate.

8. The UWB antenna of claim 1, wherein the at least one feeding line is directly coupled to one of the antenna substrates.

9. The UWB antenna of claim 1, further comprising a ground plane coupled to a bottom of the base substrate and a coupling pad coupled to a top of the base substrate and one of the antenna substrates, wherein the signal feed comprises at least one coaxial probe connector extending from the ground plane to the coupling pad.

10. The UWB antenna of claim 9, wherein the coupling pad includes impedance matching stubs.

11. The UWB antenna of claim 9, wherein:

the coupling pad comprises two differential coupling pads; and the signal feed comprises two coaxial probe connectors, each of the two coaxial probe connectors being coupled to a respective one of the two differential coupling pads.

12. The UWB antenna of claim 11, wherein the two differential coupling pads include impedance matching stubs.

13. An ultra wideband antenna comprising:

a base substrate that includes a signal feed, wherein the signal feed comprises at least one feeding line that includes an impedance matching circuit;

a ground plane coupled to the base substrate; and three or more antenna substrates communicatively coupled with the signal feed, each antenna substrate including a plurality of microstrip resonating lines;

wherein at least two of the microstrip resonating lines within each antenna substrate are of different lengths; and wherein the impedance matching circuit is provided to cooperate with the signal feed and provide impedance matching across the plurality of microstrip resonating lines within each antenna substrate.

14. The UWB antenna of claim 13, wherein the signal feed comprises two differential feeding lines each including an impedance matching circuit.

15. The UWB antenna of claim 14, wherein the microstrip resonating lines are communicatively coupled to the at least one feeding line via at least one aperture defined within the ground plane.

16. The UWB antenna of claim 14, wherein the microstrip resonating lines are communicatively coupled to the two differential feeding lines via two apertures defined within the ground plane.

17. The UWB antenna of claim 14, wherein:

the ground plane is directly coupled to one of the antenna substrates; and each differential feeding line includes a differential feeding pad to communicatively couple the differential feeding lines with the microstrip resonating lines.

18. The UWB antenna of claim 13, wherein the at least one feeding line is directly coupled to one of the antenna substrates.

19. The UWB antenna of claim 13, further comprising a coupling pad coupled to a top of the base substrate and one of the antenna substrates, wherein the signal feed comprises at least one coaxial probe connector extending from the ground plane to the coupling pad.

20. The UWB antenna of claim 19, wherein the impedance matching structure comprises impedance matching stubs coupled to the coupling pad.

21. The UWB antenna of claim 19, wherein:

the coupling pad comprises two differential coupling pads; and the signal feed comprises two coaxial probe connectors, each of the two coaxial probe connectors being coupled to a respective one of the two differential coupling pads.

22. The UWB antenna of claim 21, wherein the impedance matching structure comprises impedance matching stubs included with each coupling pad.

23. A method comprising:

arranging a base substrate that includes a signal feed, wherein the signal feed comprises at least one feeding line that includes an impedance matching circuit; and arranging two or more antenna substrates communicatively coupled with the signal feed, each antenna substrate including a plurality of microstrip resonating lines, wherein the impedance matching circuit provides impedance matching across the plurality of microstrip resonating lines.

24. The method of claim 23, wherein at least two of the microstrip resonating lines within at least one antenna substrate are of different lengths.

25. The method of claim 23, wherein at least three antenna substrates are arranged.

26. The method of claim 23, wherein the signal feed comprises two differential feeding lines each including an impedance matching circuit.

27. The method of claim 26, wherein the microstrip resonating lines are communicatively coupled to the two differential feeding lines via two apertures defined within a ground plane coupled to the base substrate.

28. The method of claim 26, wherein the ground plane is directly coupled to one of the antenna substrates and each differential feeding line includes a differential feeding pad to communicatively couple the two differential feeding lines with the microstrip resonating lines.

29. The method of claim 23, wherein the microstrip resonating lines are communicatively coupled to the at least one feeding line via at least one aperture defined within a ground plane coupled to the base substrate.

30. The method of claim 23, wherein the at least one feeding line is directly coupled to one of the antenna substrates.

31. The method of claim 23, further comprising:

arranging a ground plane coupled to a bottom of the base substrate; and arranging a coupling pad coupled to a top of the base substrate and one of the antenna substrates, wherein the signal feed comprises at least one coaxial probe connector extending from the ground plane to the coupling pad.

32. The method of claim 31, wherein the coupling pad includes impedance matching stubs.

33. The method of claim 31, wherein the coupling pad comprises two differential coupling pads and the signal feed comprises two coaxial probe connectors, each one being coupled to a respective one of the two differential coupling pads.

34. The method of claim 33, wherein the two differential coupling pads include impedance matching stubs.

* * * * *